US009494117B2

(12) United States Patent
Gargiulo et al.

(10) Patent No.: US 9,494,117 B2
(45) Date of Patent: Nov. 15, 2016

(54) VALVE ASSEMBLY FOR AN INJECTION VALVE AND INJECTION VALVE

(71) Applicant: Continental Automotive GmbH, Hannover (DE)

(72) Inventors: Luigi Gargiulo, Pisa (IT); Marco Mechi, Vada (IT); Nicola Iannaccone, Pisa (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 229 days.

(21) Appl. No.: 14/293,237

(22) Filed: Jun. 2, 2014

(65) Prior Publication Data

US 2015/0048185 A1 Feb. 19, 2015

(30) Foreign Application Priority Data

Aug. 14, 2013 (EP) ..... 13180382

(51) Int. Cl.
*B05B 1/30* (2006.01)
*F02M 51/06* (2006.01)
(Continued)

(52) U.S. Cl.
CPC ..... *F02M 51/0657* (2013.01); *F02M 51/0682* (2013.01); *F02M 51/0685* (2013.01);
(Continued)

(58) Field of Classification Search
CPC ..... F02M 51/0657; F02M 51/0682; F02M 51/0685; F02M 61/10; F02M 61/1806; F02M 61/188; F02M 2200/315; F02M 51/061; F02M 51/066; F02M 51/0635; F02M 51/0639; F02M 51/0642; F02M 51/0671; F02M 51/0675; F02M 51/0678; F02M 61/168
USPC ..... 239/584, 585.1, 585.2, 585.3, 585.4, 239/585.5, 533.2, 900
See application file for complete search history.

(56) References Cited

U.S. PATENT DOCUMENTS 5,199,648 A * 4/1993 Fujikawa ..... F02M 61/163 239/585.1
6,209,806 B1 * 4/2001 Pace ..... F02M 51/0671 239/406
8,313,084 B2 11/2012 Reiter ..... 251/129.14
(Continued)

FOREIGN PATENT DOCUMENTS

DE 102004053762 A1 5/2006 ..... B23P 13/02
DE 102005061409 A1 6/2007 ..... F02M 51/06
EP 2375051 A1 10/2011 ..... F02M 51/06

OTHER PUBLICATIONS

European Search Report, Application No. 13180382.7, 5 pages, Dec. 4, 2013.

*Primary Examiner* — Justin Jonaitis
(74) *Attorney, Agent, or Firm* — Slayden Grubert Beard PLLC

(57) ABSTRACT

A valve assembly for an injection valve includes a valve body having a cavity with a fluid inlet portion and a fluid outlet portion; a hollow valve needle axially movable in the cavity between open and closed positions to control fluid flow through the fluid outlet portion, wherein fluid can flow from the fluid inlet portion into the hollow valve needle; and an actuator assembly that actuates the valve needle and includes an axially movable armature. The valve needle includes first orifice(s) between the armature and the fluid outlet portion and second orifice(s) located adjacent or upstream of the armature. The first and second orifices allow fluid flow between the hollow valve needle and the cavity. A first gap defined between the valve needle and the armature allows fluid flow from the hollow valve needle via the second orifice into the first gap and further into the cavity.

15 Claims, 2 Drawing Sheets

(51) Int. Cl.
*F02M 61/10* (2006.01)
*F02M 61/18* (2006.01)

(52) U.S. Cl.
CPC ..... *F02M61/10* (2013.01); *F02M 61/1806* (2013.01); *F02M 61/188* (2013.01); *F02M 2200/315* (2013.01)

(56) References Cited

U.S. PATENT DOCUMENTS

2001/0052553 A1* 12/2001 Hokao ..... F02M 53/06 239/135
2003/0141476 A1* 7/2003 Sebastian ..... F02M 51/0685 251/129.19
2003/0160117 A1* 8/2003 Stier ..... F02M 51/0685 239/585.1
2005/0258276 A1* 11/2005 Delas ..... F02M 51/0671 239/533.2
2009/0184184 A1* 7/2009 Schwegler ..... F02M 51/0671 239/585.1
2012/0067982 A1 3/2012 Perry et al. ..... 239/585.3
2012/0286074 A1* 11/2012 Soriani ..... F02M 51/0682 239/585.5

* cited by examiner

VALVE ASSEMBLY FOR AN INJECTION VALVE AND INJECTION VALVE

CROSS-REFERENCE TO RELATED APPLICATIONS

This application claims priority to EP Patent Application No. 13180382 filed Aug. 14, 2013. The contents of which are incorporated herein by reference in their entirety.

TECHNICAL FIELD

The invention relates to a valve assembly for an injection valve and an injection valve.

BACKGROUND

Injection valves are in wide spread use, in particular for internal combustion engines where they may be arranged in order to dose the fuel into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a needle of the injection valve, which may, for example, be an electromagnetic actuator or piezo electric actuator.

In order to enhance the combustion process in view of the creation of unwanted emissions, the respective injection valve may be suited to dose fluids under very high pressures. The pressures may be in case of a gasoline engine, for example, in the range of up to 200 bar or even up to 500 bar and in the case of diesel engines in the range of up to 2000 bar and above.

However, during the open phase of the injector valve and after the closing phase, pressure pulsations can occur in the valve body due to fluid acceleration. These pressure pulsations can negatively influence the instantaneous mass flow and the injector linearity causing shot-to-shot instability and part-to-part variations.

SUMMARY

One embodiment provides a valve assembly for an injection valve, comprising a valve body including a central longitudinal axis, the valve body comprising a cavity with a fluid inlet portion and a fluid outlet portion, a valve needle which is hollow and axially movable in the cavity, the valve needle preventing a fluid flow through the fluid outlet portion in a closed position and releasing fluid through the fluid outlet portion in further positions, wherein the valve needle is arranged such that fluid can flow from the fluid inlet portion into the hollow valve needle and an actuator assembly being configured to actuate the valve needle, the actuator assembly comprising an armature axially movable in the cavity, wherein the valve needle comprises at least one first orifice located axially between the armature and the fluid outlet portion, the valve needle comprises at least one second orifice located in the axial range of the armature and/or an axial range extending away from the armature beginning from an axial end of the armature facing towards the fluid inlet portion, the first and second orifices are configured to allow fluid flow between the hollow valve needle and the cavity, and the valve needle and armature are arranged such that a first gap exists between the valve needle and the armature wherein the first gap is provided to allow fluid flow from the hollow valve needle via the second orifice into the first gap and further into the cavity.

In a further embodiment, the valve needle has a retainer for limiting axial displacement of the armature with respect to the valve needle in a direction away from the closed position and a disc element on the side of the armature opposite of the retainer and positioned in such fashion that it is operable to limit axial displacement of the armature with respect to the valve needle in axial direction away from the retainer and in such fashion that the armature has a predefined axial play with respect to the valve needle between the retainer and the disc element.

In a further embodiment, the first gap is annular in cross-section or comprised of one or more channels.

In a further embodiment, the first gap is approximately 0.05 mm wide.

In a further embodiment, the valve assembly further comprises an external armature guide which is movably coupled to the outer surface of the armature.

Another embodiment provides an injection valve with a valve assembly as disclosed above.

BRIEF DESCRIPTION OF THE DRAWINGS

Example embodiments of the valve assembly and the injection valve are explained below in detail with reference to the figures, in which.

DETAILED DESCRIPTION

Figure 1:
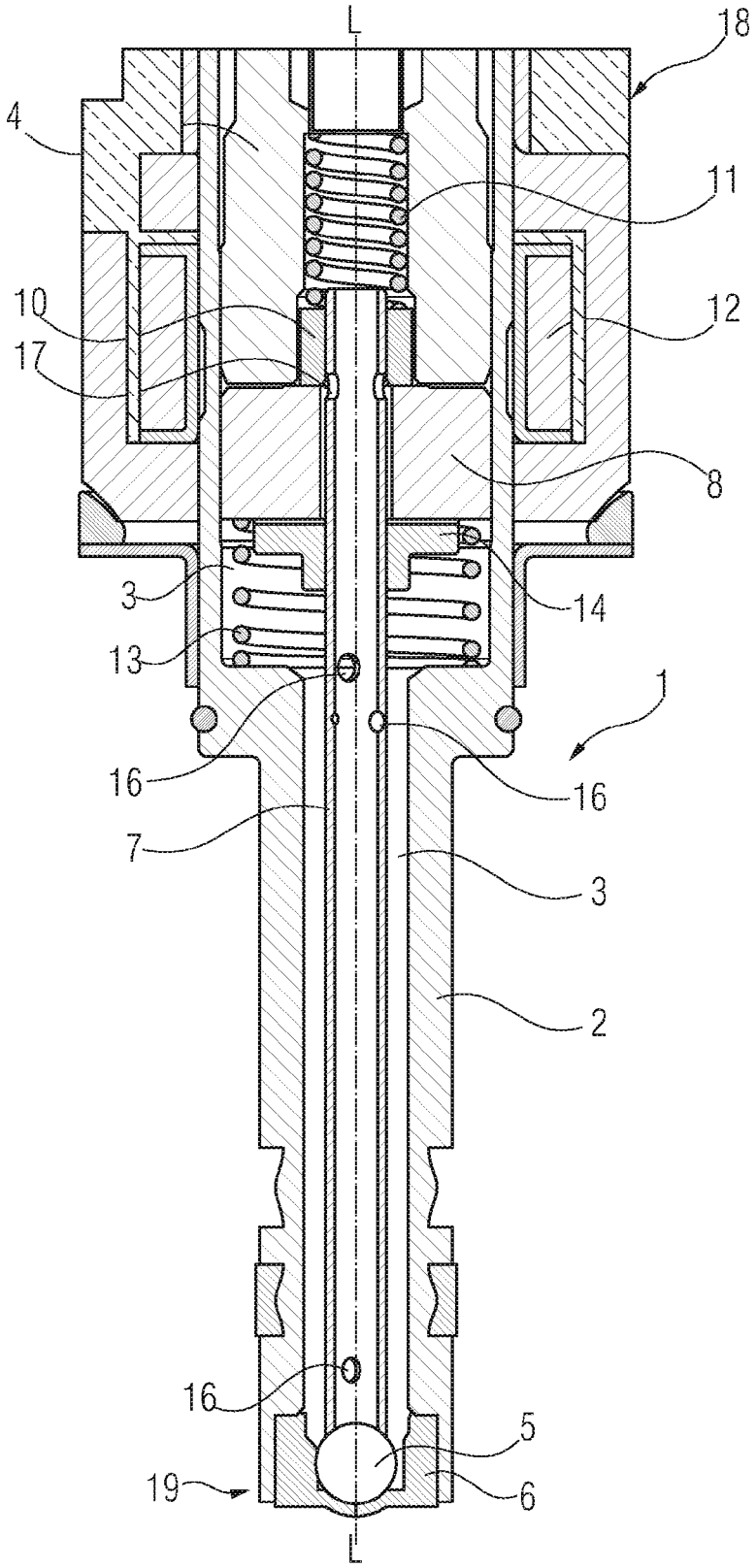
FIG. 1 shows an exemplary embodiment of a valve assembly in a longitudinal section view.

Embodiments of the present invention provide a valve assembly which facilitates a stable and reliable function.

This object is achieved by a valve assembly having the features of the independent claim. Advantageous embodiments of the valve assembly and an injection valve comprising the valve assembly are given in the sub-claims.

A valve assembly for an injection valve is specified according to one aspect. The valve assembly comprises a valve body including a central longitudinal axis. The valve body comprises a cavity with a fluid inlet portion and a fluid outlet portion. The valve assembly further comprises a valve needle which is hollow and axially movable in the cavity. The valve needle is in particular axially displaceable with respect to the valve body. The valve needle prevents fluid from flowing through the fluid outlet portion in a closed position and releases fluid through the fluid outlet portion in further positions whereby fluid can flow from the fluid inlet into the hollow valve needle.

The valve assembly further comprises an actuator assembly which is configured to actuate the valve needle and comprises an armature which is axially movable in the cavity. The armature is axially displaceable with respect to the valve body.

For actuating the valve needle, the armature is expediently operable to interact mechanically with the valve needle. For example, the armature is axially displaceable with respect to the valve needle and the valve needle has a retainer for limiting axial displacement of the armature with respect to the valve needle in a direction away from the closed position. In this way, the armature is operable to take the valve needle with it when it is moved in axial direction away from the closed position.

The retainer may be a collar which is in one piece with a hollow shaft of the valve needle. In an alternative embodiment, the retainer is a separate retainer element which is fixed to the hollow shaft. In a development, the valve needle has a disc element—which is in particular fixed to the shaft of the valve needle—on the side of the armature opposite of the retainer and positioned in such fashion that it is operable to limit axial displacement of the armature with respect to the valve needle in axial direction away from the retainer and in such fashion that the armature has a predefined axial play with respect to the valve needle between the retainer and the disc element.

The valve needle comprises at least one first orifice located axially between the armature and the fluid outlet portion. The valve needle further comprises at least one second orifice located in the axial range of the armature and/or in an axial range extending away from the armature beginning from an axial end of the armature facing towards the fluid inlet portion. The first and second orifices are configured to allow fluid flow between the hollow needle and the cavity. The first and second orifices are in particular provided in a circumferential sidewall of the hollow shaft. The second orifice is in particular positioned subsequent to the retainer in direction towards the fluid outlet portion.

The valve needle and armature are arranged such that a first gap exists between the valve needle and the armature wherein the first gap is provided for—i.e. in particular sufficiently large—to allow fluid flow from the hollow valve needle via the second orifice through the first gap and into the cavity, more specifically into the portion of the cavity which surrounds the hollow valve needle. In other words, the second orifice is connected to the valve body hydraulic volume which surrounds the hollow valve needle via the first gap. The bulk of the fluid is in particular transported from the fluid inlet portion to the fluid outlet portion through the hollow valve needle, in particular through the hollow shaft.

When the injection valve is opened, fluid begins to accelerate within the injector. Fluid acceleration inside a pipe causes pressure pulsations within the pipe and the volumes that are connected to the pipe. The magnitude of the pressure pulsations is proportional to the pipe length. Pressure pulsations in an injector are created by a first portion of the hollow valve needle into which fluid from the fluid inlet flows. This first portion of the hollow valve needle extends from the fluid inlet in the direction of the fluid outlet to a first opening in the hollow valve needle, e.g. the first orifice (if present, otherwise the fluid outlet). The greater the length of the first portion of the needle, the greater is the magnitude of the pressure pulsations. Embodiments of the invention makes use of the idea that the introduction of a second orifice located in the axial range of the valve needle along which the armature axially moves in order to move the valve needle between the closed and further positions (e.g. between the closed and completely open positions) results in the decrease of the length of the first portion of the valve needle. The magnitude of the pressure pulsations is thereby reduced without any considerable reduction in the fluid flux.

The position of the second orifice is preferably close to the fluid inlet portion of the cavity. This ensures that the length of the first portion of the valve needle is as short as possible and the magnitude of the pressure pulsations correspondingly low as possible.

In one embodiment, the retainer is fixedly coupled to the outer surface of the valve needle close to the end of the valve needle into which fluid from the fluid inlet flows into the hollow valve needle. The retainer is in turn connected to a first spring element which exerts a force on the retainer and, thus, on the valve needle such that the needle is biased towards the closed position. In this case the second orifice is preferably located close to the retainer in the direction of fluid flow. The second orifice is preferably located between the retainer and the first orifice.

In a further embodiment, the disc element is fixedly coupled to the outer surface of the valve needle between the armature and the fluid outlet portion of the cavity. The disc element may be operable to provide a dampening effect on the armature by decreasing its velocity—in particular due to hydraulic forces by means of fluid being squeezed out of a gap between the armature and the disc element—before the armature comes to a stop by contacting the disc element.

In a further embodiment comprising a retainer and a disc element, the second orifice is preferably located between the retainer and the disc element.

In a further embodiment the first gap is annular in cross-section. For example, the armature has a central opening through which the hollow shaft of the valve needle extends and the diameter of the central opening is larger than the outer diameter of the hollow shaft in the region where both overlap axially. Alternatively or additionally, the first gap is comprised of one or more channels which hydraulically connect the second orifice with the cavity volume.

In order to ensure that the fluid exiting the hollow needle via the second orifice is hydraulically connected to the fluid in the cavity, that is, that fluid from the second orifice flows through the first gap between the valve needle and the armature, the diameter clearance between the armature and the valve needle is preferably in a range between 0.01 mm and 0.1 mm, in particular between 0.025 mm and 0.05 mm. For example, the clearance has a value of 0.05 mm.

In a further embodiment, the armature is movably coupled to an external armature guide on the external surface of the armature. The external surface of the armature is in particular an outer circumferential surface, i.e. in particular a surface remote from the longitudinal axis and adjacent to a circumferential side wall of the valve body. The external armature guide may be represented by a portion of the circumferential side wall of the valve body and may be in particular operable to guide the armature in axial direction. The external armature guide ensures that the first gap of sufficient magnitude is maintained between the armature and valve needle and that the armature is maintained approximately parallel to the valve needle.

The valve needle may also be guided in axial direction, for example by means of the retainer mechanically interacting with the valve body. With advantage, axial guidance of the valve needle may be independent of the axial guidance of the armature in this way so that a satisfactory magnitude of the first gap is particularly easy to maintain.

According to another aspect, an injection valve with a valve assembly according to one of the aforementioned embodiments is specified.

FIG. 1 shows a valve assembly 1 for an injection valve. The injection valve is a fluid injection valve, in particular a fuel injection valve for dosing fuel into the combustion chamber of an internal combustion engine.

The valve assembly 1 comprises a valve body 2 with a central longitudinal axis L. The valve body 2 comprises a cavity 3 with a fluid inlet portion 18 in which a pole piece 4 is located and a fluid outlet portion 19 where a valve seat 6 is arranged.

Figure 2:
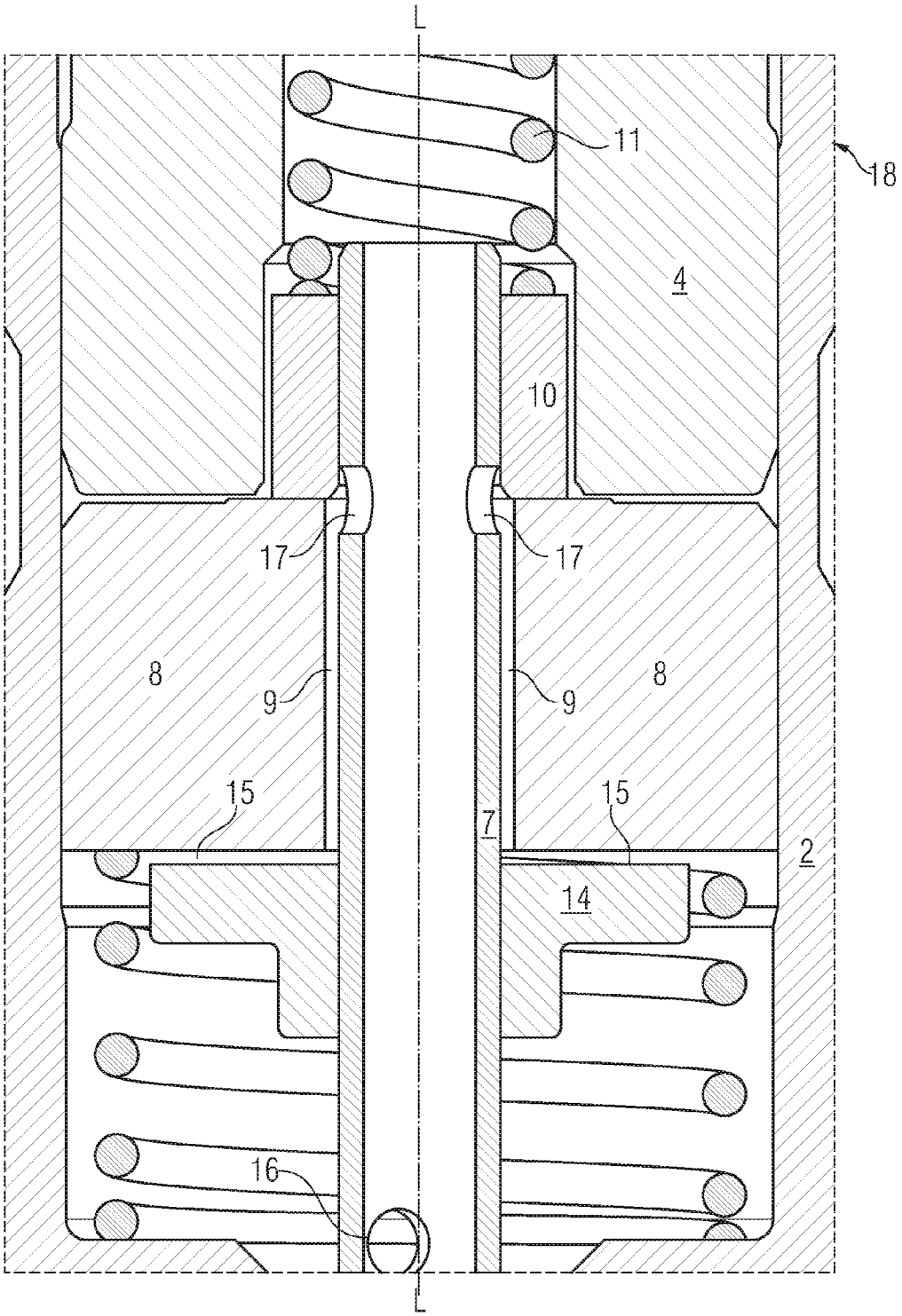
FIG. 2 shows an enlarged view of the section of the exemplary embodiment of the valve assembly of FIG. 1.

A hollow valve needle 7 is arranged in the cavity 3 such that it is axially movable between a closed position and a fully open position. The valve needle 7 has a hollow shaft and a valve ball fixed to one end of the shaft. The valve needle 7 prevents fluid flow through the fluid outlet portion 19 in the closed position by means of the valve ball 5 contacting the seat 6 for sealing the fluid outlet portion. In the fully open position, the valve ball 5 is spaced apart from the seat 6 so that the valve needle 7 releases fluid through the fluid outlet portion 19. In FIGS. 1 and 2 the valve needle 7 is pictured in the fully open position.

The valve needle 7 is coupled to an armature 8 such that a first gap 9 exists between the outer surface of the valve needle 7 and the armature 8. The width of the first gap is maintained by an external armature guide which is represented by that portion of the valve body 2 which axially overlaps the armature 8.

The end of the shaft of the valve needle 7 which is located in the fluid inlet portion 18 of the cavity 3 is fixedly coupled to a retainer 10, e.g. by welding. The valve needle 7 is attached to a first spring element 11 via the retainer 10. The spring element maintains the valve needle 7 in the closed position when no other forces are acting upon it. The armature 8 moves the valve needle 7 into an open position against the force of the first spring element 11 by means of mechanical interaction with the retainer 10. The armature 8 is moved by an electromagnetic force generated by a coil 12 of the actuator assembly. A second spring 13 is attached to the armature 8 to bias the armature 8 towards the retainer 10. In particular, the armature 8 is pushed into contact with the retainer 10 by the second spring 13 when no magnetic or other force is applied.

A disc element 14—which may also be denoted as a hydro disc—is fixedly attached to the outer surface of the hollow shaft of the valve needle 7 in such a position that it can decrease the velocity of the armature 8 and ultimately stop the armature when the valve needle 7 stops in the closed position and the armature 8 decouples from the retainer 10 due to its inertia and moves further towards the fluid outlet portion 19.

As shown in FIGS. 1 and 2 there is a second gap 15 between the armature and the hydro disc 14 in the open position. This second gap 15 extends radially outward from the first gap 9 and connects to the cavity 3 volume.

The valve needle 7 includes a number of first orifices 16 axially located between the hydro disc 12 and the fluid outlet of the valve assembly 1 and a number of second orifices 17 axially located between the hydro disc 14 and the retainer 10.

In the present example the second orifices 17 are arranged partially underneath the retainer 10, i.e. the second orifices 17 are partially covered by the retainer 10. In this way, fluid flow out of the second orifices 17 may advantageously be deflected away from a radial direction and towards the fluid outlet portion 19.

The first gap 9 is annular in shape but may alternatively be comprised of one or more channels connecting the fluid flowing from the second orifices 17 to fluid in the cavity 3 in the vicinity of the second spring element 13. The first gap 9 extends, in axial direction, from the second orifices 17 to the second gap 15. Thus, fluid may flow out of the hollow shaft of the valve needle 7 through the second orifices 17 in the sidewall of the shaft, may flow further in axial direction through the first gap 9 along the armature 8 and the shaft and subsequently in radial direction through the second gap 15 along a bottom surface of the armature 8 and along the disc element 14.

When the valve needle 7 is displaced away from the closed position to a further position towards the fully open position where the armature 8 abuts the pole piece 4, fluid flows through the fluid inlet portion 18 of the cavity 3 inside of the pole piece 4 into the hollow valve needle 7. The bulk of the fluid flows through the hollow needle 7, leaves the hollow valve needle 7 through the first orifices 16 into the portion of the cavity 3 which surrounds the valve needle 3 and is released from the cavity 3 at the fluid outlet portion 19 when the valve needle 7 is displaced axially away from the closed position, i.e. when the valve ball 5 is spaced apart from the seat 6. A small portion of the fluid exits the valve needle 7 via the second orifices 17 and flows into the portion of the cavity 3 between the outer surface of the valve needle 7 and the inner surface of the valve body 2 through the first and second gaps 9, 15. The position of the second orifices 17 leads to the reduction in magnitude of pressure pulsations.

What is claimed is:

1. A valve assembly for an injection valve, comprising:

a valve body having a central longitudinal axis, the valve body comprising a cavity with a fluid inlet portion and a fluid outlet portion, a hollow valve needle axially movable in the cavity, the valve needle preventing a fluid flow through the fluid outlet portion in a closed position and releasing fluid through the fluid outlet portion in further positions, wherein the valve needle is arranged to allow fluid flow from the fluid inlet portion into the hollow valve needle, and an actuator assembly configured to actuate the valve needle and comprising an armature axially movable in the cavity, wherein the valve needle comprises:

at least one first orifice located axially between the armature and the fluid outlet portion, and at least one second orifice located in at least one of the axial range of the armature and an axial range extending away from the armature beginning from an axial end of the armature facing towards the fluid inlet portion, wherein the first and second orifices are configured to allow fluid flow between the hollow valve needle and the cavity, and wherein the valve needle and armature are arranged such that a first gap exists between the valve needle and the armature, the first gap allowing fluid flow from the hollow valve needle via the second orifice into the first gap and further into the cavity.

2. The valve assembly of claim 1, wherein the valve needle has:

a retainer that limits axial displacement of the armature with respect to the valve needle in a direction away from the closed position, and a disc element on a side of the armature opposite of the retainer and positioned to limit axial displacement of the armature with respect to the valve needle in an axial direction away from the retainer, and such that the armature has a predefined axial play with respect to the valve needle between the retainer and the disc element.

3. The valve assembly of claim 1, wherein the first gap is annular in cross-section or comprises one or more channels.

4. The valve assembly of claim 3, wherein the first gap has a width of approximately 0.05 mm.

5. The valve assembly of claim 1, further comprising an external armature guide movably coupled to the outer surface of the armature.

6. An injection valve, comprising:

a valve assembly comprising:

a valve body having a central longitudinal axis, the valve body comprising a cavity with a fluid inlet portion and a fluid outlet portion, a hollow valve needle axially movable in the cavity, the valve needle preventing a fluid flow through the fluid outlet portion in a closed position and releasing fluid through the fluid outlet portion in further positions, wherein the valve needle is arranged to allow fluid flow from the fluid inlet portion into the hollow valve needle, and an actuator assembly configured to actuate the valve needle and comprising an armature axially movable in the cavity, wherein the valve needle comprises:

at least one first orifice located axially between the armature and the fluid outlet portion, and at least one second orifice located in at least one of the axial range of the armature and an axial range extending away from the armature beginning from an axial end of the armature facing towards the fluid inlet portion, wherein the first and second orifices are configured to allow fluid flow between the hollow valve needle and the cavity, and wherein the valve needle and armature are arranged such that a first gap exists between the valve needle and the armature, the first gap allowing fluid flow from the hollow valve needle via the second orifice into the first gap and further into the cavity.

7. The injection valve of claim 6, wherein the valve needle of the valve assembly has:

a retainer that limits axial displacement of the armature with respect to the valve needle in a direction away from the closed position, and a disc element on a side of the armature opposite of the retainer and positioned to limit axial displacement of the armature with respect to the valve needle in an axial direction away from the retainer, and such that the armature has a predefined axial play with respect to the valve needle between the retainer and the disc element.

8. The injection valve of claim 6, wherein the first gap is annular in cross-section or comprises one or more channels.

9. The injection valve of claim 8, wherein the first gap has a width of approximately 0.05 mm.

10. The injection valve of claim 6, wherein the valve needle of the valve assembly further comprises an external armature guide movably coupled to the outer surface of the armature.

11. An internal combustion engine, comprising:

an injection valve having a valve assembly comprising:

a valve body having a central longitudinal axis, the valve body comprising a cavity with a fluid inlet portion and a fluid outlet portion, a hollow valve needle axially movable in the cavity, the valve needle preventing a fluid flow through the fluid outlet portion in a closed position and releasing fluid through the fluid outlet portion in further positions, wherein the valve needle is arranged to allow fluid flow from the fluid inlet portion into the hollow valve needle, and an actuator assembly configured to actuate the valve needle and comprising an armature axially movable in the cavity, wherein the valve needle comprises:

at least one first orifice located axially between the armature and the fluid outlet portion, and at least one second orifice located in at least one of the axial range of the armature and an axial range extending away from the armature beginning from an axial end of the armature facing towards the fluid inlet portion, wherein the first and second orifices are configured to allow fluid flow between the hollow valve needle and the cavity, and wherein the valve needle and armature are arranged such that a first gap exists between the valve needle and the armature, the first gap allowing fluid flow from the hollow valve needle via the second orifice into the first gap and further into the cavity.

12. The internal combustion engine of claim 11, wherein the valve needle of the valve assembly has:

a retainer that limits axial displacement of the armature with respect to the valve needle in a direction away from the closed position, and a disc element on a side of the armature opposite of the retainer and positioned to limit axial displacement of the armature with respect to the valve needle in an axial direction away from the retainer, and such that the armature has a predefined axial play with respect to the valve needle between the retainer and the disc element.

13. The internal combustion engine of claim 11, wherein the first gap is annular in cross-section or comprises one or more channels.

14. The internal combustion engine of claim 13, wherein the first gap has a width of approximately 0.05 mm.

15. The internal combustion engine of claim 11, wherein the valve needle of the valve assembly further comprises an external armature guide movably coupled to the outer surface of the armature.

* * * * *